United States Patent [19]

Sakane et al.

[11] Patent Number: 4,458,625

[45] Date of Patent: Jul. 10, 1984

[54] FIXING APPARATUS

[75] Inventors: Isamu Sakane; Chiaki Kato, both of Osaka, Japan

[73] Assignee: Sumitomo Electric Industries, Ltd., Osaka, Japan

[21] Appl. No.: 258,354

[22] Filed: Apr. 28, 1981

[30] Foreign Application Priority Data

Feb. 19, 1981 [JP] Japan ..... 56-23717
Mar. 17, 1981 [JP] Japan ..... 56-38854

[51] Int. Cl.[3] ..... B05C 11/00

[52] U.S. Cl. ..... 118/60; 118/70; 118/264; 118/268; 432/60

[58] Field of Search ..... 118/60, 70, 267, 268, 118/264; 432/60

[56] References Cited

U.S. PATENT DOCUMENTS 3,745,972 7/1973 Thettu ..... 118/60 X
4,359,963 11/1982 Saito et al. ..... 432/60 X

FOREIGN PATENT DOCUMENTS 53-118140 10/1978 Japan ..... 118/60

*Primary Examiner*—Evan K. Lawrence
*Attorney, Agent, or Firm*—Sughrue, Mion, Zinn, Macpeak & Seas

[57] ABSTRACT

An apparatus for fixing a toner image by transporting a toner image bearing material as it is held between a fixing roll and a compression roll. In the apparatus, which is positioned above the fixing roll, a release agent having a viscosity of 50 to 100,000 cS is applied onto the surface of the fixing roll through a porous fluorocarbon resin membrane having a pore size of 0.01 to 10 μm, a porosity of 35 to 85%, and a thickness of 50 μm to 1 mm. The porous membrane may be located on the inner surface of the bottom of a tank containing the release agent above an opening in the tank bottom.

17 Claims, 19 Drawing Figures

FIXING APPARATUS

BACKGROUND OF THE INVENTION

The present invention relates to an apparatus for applying a release agent onto the surface of a fixing roll of, for example, a plain paper copying (PPC) machine.

In a fixing mechanism of a PPC machine, paper bearing a transferred toner image is passed between a heated metal roll and a rubber roll or other elastic rolls under pressure at a temperature between 150° and 200° C. until the image is fixed. In this mechanism, it frequently occurs that the paper bearing a toner image is wound around the metal roll or elastic roll thereby preventing complete printing or jamming the machine. To avoid these problems, various techniques have been proposed, among which is the use of a fluorocarbon resin coating on the surface of the metal roll.

Whether a fluorocarbon resin coating is applied or not, all conventional types of fixing mechanisms apply an additional coating of a release agent onto the surfaces of the metal roll and elastic roll. However, it is very difficult to apply a release agent coating uniformly and in the right amount. If the amount is too large, it forms a blotch on the paper or discolors the paper. At the same time, rapid consumption of the release agent requires frequent and uneconomical refilling. Furthermore, excess release agent coagulated on the surface of the roll can cause unexpected trouble with the machine. If too small an amount of the release agent is applied, the releasability of the roll surface from paper is unavoidably reduced leading to the problem of the paper being wound around the roll. Typical release agents are silicone oil and other heat-resistant oils.

U.S. Pat. Nos. 3,718,116 and 3,745,972 disclose an applicator for the release agent which uses a two-layered felt, a dense felt layer and a loose felt layer. Use of this applicator prevents excessive application of the release agent by contacting a roll and the surface of the dense felt layer. However, the amount of release oil applied using this applicator is still large, particularly when its viscosity is low. A more serious defect with this applicator is that the felt tends to become clogged by toner or carrier particles which causes various problems in fixing due, for example, to scratches on the surface of the fixing roll or uneven application of the release oil. As a consequence, the felt must be replaced frequently which is not only uneconomical but also makes consistent operation of the fixing apparatus difficult.

A fixing apparatus that is designed to eliminate this defect is described in Japanese Published Patent Application No. 110049/77. The characteristic feature of this apparatus that the dense felt layer is eliminated and instead at least part of the felt structure is replaced by tetrafluoroethylene resin foam. This arrangement is inteneded to prevent excessive application of the release oil. But, since the pore size of the tetrafluoroethylene resin foam is not controlled satisfactorily in this apparatus, the amount of release oil applied is still great. Furthermore, the use of a large heat-resistant felt structure makes the overall apparatus complex, large in size, and costly. Moreover, because the felt absorbs the oil, not only does it take a long time before the application of the oil onto the fixing roll can be started, but also the oil absorbed by and held in the felt is entirely wasted. A more serious defect is that the method of fixing the tetrafluoroethylene resin foam involves problems to be solved.

SUMMARY OF THE INVENTION

The disadvantages described above are eliminated with the utilization of the present invention which provides a novel fixing apparatus that is compact in size and simple to use for achieving the desired application of release agent. With this apparatus, a coating of the release agent can be applied in a much smaller thickness than can be provided with the conventional apparatus. Furthermore, the agent is supplied in the required amount only when the temperature of the fixing roll is sufficiently high and it is not supplied when the copying machine is not in service.

The invention provides a fixing apparatus positioned above a fixing roll which applies a coating of release agent onto the surface of the fixing roll through a porous fluorocarbon resin membrane having micropores of a uniformly controlled size, preferably in the range of from 0.01 to 10 μm, having a porosity of 35 to 85%, and a thickness of 50 μm to 1 mm.

DESCRIPTION OF THE PREFERRED EMBODIMENTS

For the purposes of the invention, porous fluorocarbon resin membranes of suitable characteristics are used with the particular characteristics selected in accordance with the viscosity and the required amount of the release agent applied. The porous fluorocarbon resin membrane is preferably a porous tetrafluoroethylene resin having pores of a highly uniformly controlled size. An example of such a resin is Poreflon TM manufactured by Sumitomo Electric Industries, Ltd. of Japan. This product, which is described in Japanese Published Patent Application Nos. 13560/67 and 42794/78, is produced by extruding or rolling a tetrafluoroethylene resin blend containing a liquid lubricant, drawing the extruded or rolled blend, and sintering the same in a fixed state. Since the porous tetrafluoroethylene resin membrane has very fine pores of a size as small as 0.01 to 10 μm, the release agent supplied oozes out by passing through the pores very slowly. As the temperature of the applicator is increased, the viscosity of the release agent is decreased and the agent oozes out more easily. As a result, the release agent can be supplied onto the surface of the fixing roll only when the copying machine is in service.

Figure 1:
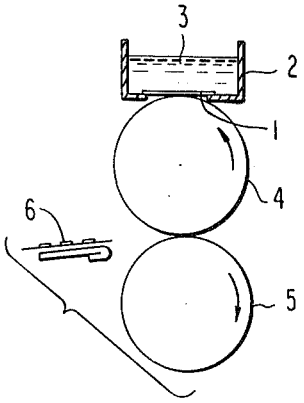
FIG. 1 schematically represents a cross section of a fixing apparatus using a porous fluorocarbon resin membrane.

FIG. 1 shows a preferred embodiment of the apparatus of the invention wherein a porous fluorocarbon resin membrane 1 is fixed to the inner surface of the bottom of a tank for storing release oil 2.

Figure 2:
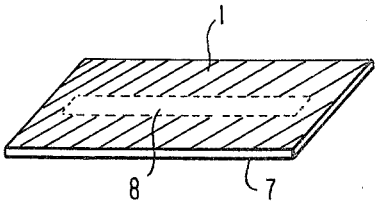
FIG. 2 shows a porous fluorocarbon resin membrane having an area wherein the pores are closed.

In another embodiment, the amount of the release agent applied is reduced further and the agent is applied onto the fixing roll only through the area where the porous fluorocarbon resin membrane contacts the roll. This is shown in FIG. 2 wherein the porous fluorocarbon resin membrane has an area 7 the pores of which are closed and an area 8 having open pores through which the release agent is applied. The area 7 can be formed by closing the pores in that area by compression or by coating the area with a heat-resistant rubber such as fluorocarbon rubber or silicone rubber or by pressing a heat-resistant, high molecular, synthetic resin membrane such as a fluorocarbon resin to the area while heating.

Figure 3A:
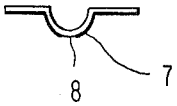
FIG. 3 shows a porous fluorocarbon resin membrane having a projection.
Figure 4:
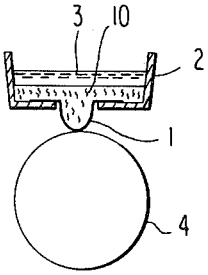
FIG. 4 shows the porous fluorocarbon resin membrane of FIG. 3 as it is attached to the inner surface of the bottom of a tank for storing a release agent with the projection being filled with a shape retaining member.
Figure 5:
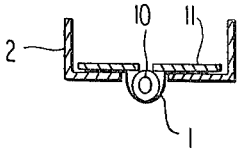
FIG. 5 shows a porous fluorocarbon resin membrane mounted between a tank for storing release agent and a holding plate with the projection on the membrane being filled with a shape retaining member having a circular cross section.

In the arrangement of FIG. 1, in some applications, the porous fluorocarbon resin membrane may not contact the fixing roll satisfactorily so that upon heating the membrane ruptures thereby letting the oil tank contact and damage the roll. An arrangement for providing good contact between the porous fluorocarbon resin membrane and the fixing roll is illustrated in FIGS. 3(a) and (b). Here, the membrane is provided with a linear zonal projection 9 that is formed by heat and which contacts the circumferential surface of the fixing roll in an axial direction. A concave portion of the projection is filled with a member to retain the shape thereof. The shape retaining member is required to maintain the shape of the projection of the porous fluorocarbon resin membrane and to provide good contact between the membrane and the fixing roll. The member is also required to have a hardness that does not affect the surface of the fixing roll at all, as well as heat-resistance and the ability to hold the release agent. A material that satisfies all of these requirements is heat-resistant felt 10 that is fitted in the projection as shown in FIG. 4. However, it is very difficult and expensive to fit a sufficiently large volume of heat-resistant felt in the projection as shown in FIG. 4 that it provides a suitable degree of hardness and forms a flat top of the projection that is necessary for achieving good contact between the porous membrane and the fixing roll. Therefore, a more suitable material for the shape retaining membrane is a hollow or solid porous material having a circular cross section. Preferred examples are a porous tetrafluoroethylene resin tube having pores larger than those of the porous fluorocarbon resin membrane and a porosity of 50 to 85%, a porous tetrafluorocarbon resin cylinder having a porosity of 35 to 85%, and a heat-resistant felt cylinder. These materials can be simply installed by holding them under a slotted plate 11 as shown in FIG. 5. By using one of these materials, all the disadvantages mentioned above can be eliminated.

Figure 6A:
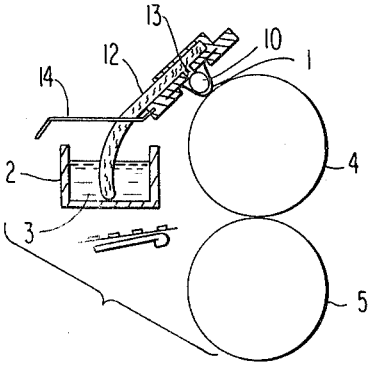
FIG. 6(a) is a cross section of the fixing apparatus wherein the tank for storing release agent is positioned below the porous fluorocarbon resin membrane and FIG. 6(b) is a plan view of the apparatus in FIG. 6(a)
Figure 6B:
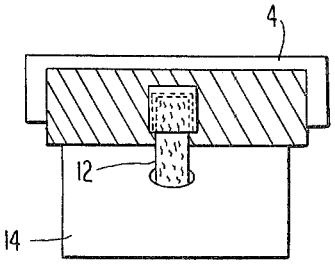

If the function and relative position of the tank for storing the release agent make it difficult to position it above the fixing roll, the following arrangement shown in FIG. 6(a) can be used. One end of member 12 by which supplies the release agent 3 is immersed in the agent in the storing tank and the other end is in placed contact with at least part of a shape retaining member having a circular cross section 10 fitted in the concave portion of a projection in the porous fluorocarbon resin membrane (1) with the point of contact being indicated at 13. The release agent is supplied to the shape retaining member by capillary action and is then applied onto the surface of the fixing roll through the porous fluorocarbon resin membrane. The member used to supply the release agent need not be heat-resistant, and it may be made of felt, sponge, nonwoven fabric, woven fabric or a microfine glass tube having an inside diameter of not more than 0.5 mm. FIG. 6(b) is a plan view of FIG. 6(a). As shown therein, the size of the member 12 used to supply the release agent can be properly selected depending upon the absorption rate of the release agent and the amount to be applied. In FIGS. 6(a) and (b), a spring member for controlling the pressure of contact between the porous fluorocarbon resin membrane and the fixing roll is indicated at 14.

Figure 7:
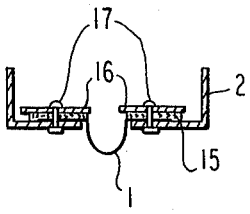
FIG. 7 is a diagram illustrating how the porous fluorocarbon resin membrane of FIG. 3 is fixed to a metallic tank for storing release agent.

A method for fixing the porous fluorocarbon resin membrane in the shapes described above is illustrated in FIG. 7, wherein a porous fluorocarbon resin membrane 1 is held between the inner surface of the bottom of a metal tank 2 which stores release agent and a layer of packing 15 such as fluorocarbon rubber or silicone rubber. A plate 16 is fixed to the packing by screws 17.

This procedure is complicated enough to involve much labor and time. Moreover, the fitting of the shape retaining member increases the number of parts to be assembled and hence the cost. As a further disadvantage, the release oil may tend to leak from around the screws and other gaps through the packing after it has been used for an extended period of time. Thus, the release oil may leak out through an area other than the area of the porous fluorocarbon resin membrane where the pores are provided.

Figure 3B:
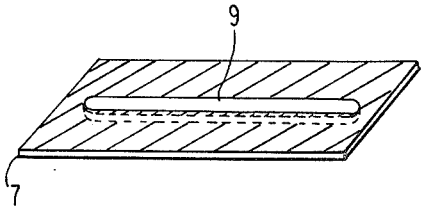

Another aspect of the invention is the solution of this problem and the provision of a fixing apparatus that can be assembled in a short time. According to this aspect, the porous fluorocarbon resin membrane 1 is held, as shown in FIG. 5, between the tank for storing release agent and a holding plate 11, each formed of thermoplastics. A slot is formed in both the bottom of the tank and the holding plate extending in a longitudinal direction. The porous membrane, which should be not larger than the holding plate, is placed on the bottom of the tank in such a manner that the linear zonal projection 9 that contacts the circumferential surface of the fixing roll fits into the slot in the bottom of the tank. Subsequently, the holding plate is fusion-bonded to the inner surface of the bottom of the tank with heat. In this embodiment, the pores in the area of the porous fluorocarbon resin membrane other than the linear zonal projection that contact the circumferential surface of the fixing roll in an axial direction are also closed, as shown in FIG. 3, so that the release agent oozes out of the membrane only through the pores in that zonal projection. The concave portion of the projection is filled with a shape retaining member 10 before or after the porous fluorocarbon resin membrane is fixed to the bottom of the storage tank.

Figure 8:
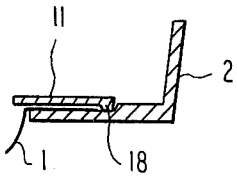
FIGS. 8, 9 and 10 are diagrams illustrating how the porous fluorocarbon resin membrane is fusion-bonded to the inner surface of the bottom of a storing tank of thermoplastic resin under heating.

It is very difficult to achieve uniform fusion bonding between the bottom of the storage tank and the holding plate throughout an area as large as at least 100 $cm^2$. Therefore, according to the invention, a rib 18 is formed around the holding plate 11 as shown in FIG. 8, and the holding plate is bonded to the bottom of the storage tank on the periphery of the plate by quick ultrasonic or high-frequency welding. The rib 18 may be thicker than the porous fluorocarbon resin membrane by 0.05 to 0.5 mm. With such a thickness, the membrane is securely held between the holding plate and the bottom of the tank by the welding process, the membrane will not easily slip off and a good seal is provided between the holding plate and the bottom of the tank.

Figure 9A:
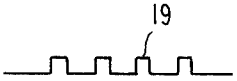
Figure 9B:
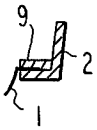
Figure 9C:
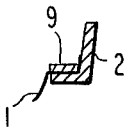
Figure 10:
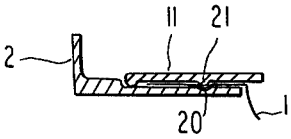

Nonetheless, it is still difficult to weld a small portion of the porous fluorocarbon resin membrane and achieve a high resistance to slippage from between the holding plate and the bottom of the tank. To weld a small portion of the porous fluorocarbon resin membrane that will not easily slip from between the holding plate and the bottom of the tank, a flank of porous fluorocarbon resin sheet can be stamped into a form having lugs as shown in FIG. 9(a), positioned between the holding plate and bottom of the tank, and welded in the manner shown in FIGS. 9(b) and (c). The portions where the lug, holding plate and the bottom of the tank are welded together alternate with those where only the plate and bottom of the tank are welded. By this arrangement, a good seal is obtained between the holding plate and the bottom of the tank and the resistance of the membrane against slippage is three to five times as great as the value obtained otherwise. To provide an even better seal, a groove 20 is formed in the inner surface of the bottom of the tank 2 and a projection 21 is formed in the holding plate 11 as shown in FIG. 10.

The thermoplastic resin of which the storage tank and the holding plate are made is selected with advantage from glass fiber reinforced engineering plastics because such materials have a good resistance to heat and oil and are heat-sealable by ultrasonic or high-frequency welding. Particularly preferred examples are a polyphenylene sulfide (PPS) resin containing 10 to 35% of glass fibers, 6,6-nylon containing not more than 40% of glass fibers, and a polyethylene terephthalate (FR-PET) resin containing 5 to 40% of glass fibers.

The fixing apparatus of the invention will now be described in greater detail by reference to the following examples which are given here for illustrative purposes only and are by no means intended to limit the scope of the invention.

EXAMPLE 1

A porous tetrafluoroethylene resin membrane ("Poreflon TM" manufactured by Sumitomo Electric Industries, Ltd. having a pore size=0.05 μm, porosity=35%, thickness=100 μm) and a tetrafluoroethylene/hexafluoroethylene resin sheet (50 μm thick) having a slot 10 mm wide and 35 cm long were pressed together by a hot press (2 $kg/cm^2$) at 280° C. to provide a laminated sheet as shown in FIG. 2 wherein the pores in the area of Poreflon TM corresponding to the slot (10 mm wide and 35 cm long) remained open. The sheet was reinforced with felt (5 mm thick) that was placed on the side opposite the tetrafluoroethylene/hexafluoroethylene resin sheet. The thus prepared sheet was set in a commercial PPC copying machine (available from Ricoh Co., Ltd.) in such a manner that slotted side of the sheet was in contact with the surface of the smaller Teflon TM -coated fixing roll.

The copying machine was of a type using silicone oil #KF 96 (100 cS) as a release agent. About 5 minutes after the machine was switched on, when the temperature of the surface of the fixing roll reached about 160° C., silicone oil oozed only through the slotted area of the porous tetrafluoroethylene resin membrane. During a hundred thousand passes of copying paper, no paper was wound around the roll, the membrane wore little, and there was no blocking problem due to toner or carrier particles.

Subsequently, the supply unit was removed from the copying machine and sheets of copying paper were fed through the machine. The paper than tended to be wound around the fixing roll without being released easily. This demonstrates that the supply unit of the invention supplied only a very small amount of silicone oil onto the surface of the fixing roll as in fact is desired.

EXAMPLE 2

A porous tetrafluoroethylene resin membrane ("Poreflon" having a pore size=2.0 μm, porosity=80%, thickness=0.4 mm) having a projection was formed using heating. All of the membrane area except the projection, which measured 6 mm wide and 35 cm long, was covered with a fluorocarbon rubber adhesive to form an area as shown in FIG. 3 wherein the pores were collapsed. The concave portion of the projection was filled with a shape retaining member that was a porous tetrafluoroethylene resin tube having a pore size of 3.0 μm, porosity of 70% and a wall thickness of 2 mm. The thus prepared sheet was attached to the bottom of a metal oil tank and set in a commercial PPC machine of the same type as in Example 1 so that the porous side was in close contact with the surface of the fixing roll. After filling the tank with 20 cc of silicone oil (30,000 cS), a test was conducted as in Example 1. Because the oil had a high viscosity, none of it would pass through the porous side at room temperature. However, the temperature of the surface of the fixing roll reached 150° C., the slotted area of the membrane became transparent indicating that the oil was oozing out through the membrane. Sheets of copying paper were fed through the machine when it was operational, and no paper was wound around the fixing roll and hence a large number of copies could be made without difficulty. Almost all of the initial charge of silicone oil remained in the tank even after a hundred thousand passes demonstrating that the consumption of the silicone oil in the supply unit of the invention was very small. In addition, it was surprising indeed that not a single sheet of paper was wound around the roll during 100,000 operations.

EXAMPLE 3

Figure 11:
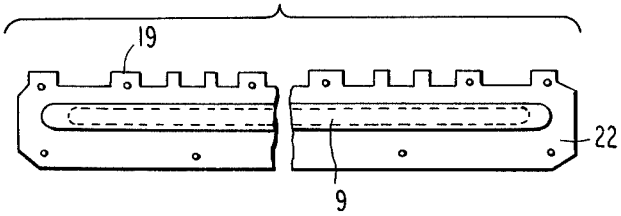
FIG. 11 shows a porous tetrafluoroethylene resin membrane stamped out into a form as shown in FIG. 9.

A porous tetrafluoroethylene resin membrane (pore size=0.5 μm, porosity=75%, thickness=200 μm) having a projection and a tetrafluoroethylene/hexafluoroethylene resin film (50 μm thick) having a slot 3 mm wide and 28 cm long were pressed together by a hot press (2 $kg/cm^2$) at 305° C. to provide a laminated sheet in such a manner that the slot was along the center of the projection as shown in FIG. 3. The laminate thus prepared was stamped into a form as illustrated in FIG. 11.

Figure 12A:
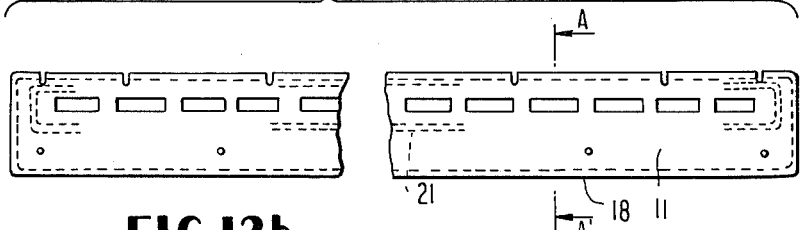
FIG. 12(a) is a plan view of an injection-molded holding plate made of a polyphenylene sulfide resin.
Figure 12B:
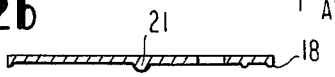
FIG. 12(b) is a cross section of FIG. 12(a) taken on a line A–A'.
Figure 13A:
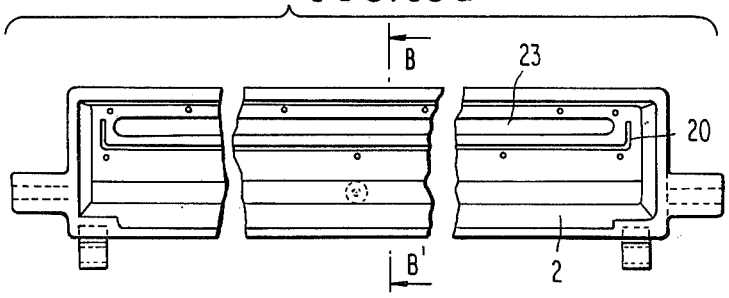
FIG. 13(a) is a plan view of an injection-molded tank for storing release agent composed of a polyphenylene sulfide resin.
Figure 13B:
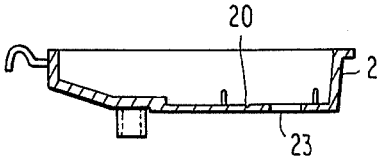
FIG. 13(b) is a cross section of FIG. 13(a) taken on a line B–B'.

By injection molding, a holding plate and a tank for storing release agent of the shapes shown in FIGS. 12 and 13 were made of a polyphenylene sulfide (PPS) resin with a glass fiber content of 30%. As described hereinabove, a rib 18 was formed around the holding plate 11 and to provide a good seal, a projection was formed in the holding plate and a groove 20 in the tank. The sheet of FIG. 11 was placed in the tank so that the projection 9 fitted in a slot 23 formed in the bottom of the tank. The concave portion of the projection was filled with a porous tetrafluoroethylene resin tube (pore size=1.0 μm, porosity =75%, wall thickness=1 mm), and thereafter the holding plate was bonded to the bottom of the tank with an ultrasonic plastic welder. The overall setup time including the welding period was only about one minute, and the resulting assembly was light in weight. The tank was filled with 50 cc of silicone oil (10,000 cS). Even at room temperature, it took only a few hours before the oil passing through the porous tetrafluoroethylene resin tube came out through the area of the porous fluorocarbon resin membrane that corresponded to the slot in the tetrafluoroethylene/hexafluoroethylene resin film. The thus prepared supply unit of the invention was set in a commercial PPC machine of the same type as in Example 1. The area of the porous fluorocarbon resin membrane that corresponded to the slot in the tetrafluoroethylene/hexafluoroethylene resin film made very intimate contact with the surface of the fixing roll, and throughout 100,000 passes, no paper was wound around the roll, and the consumption of the silicone oil was no more than about 40 cc indicating that the supply system of the invention continuously applied a coating of the silicone oil uniformly and in a very small quantity. The oil leaked through no part of the porous fluorocarbon resin membrane other than that corresponding to the slot in the tetrafluoroethylene/hexafluoroethylene resin film.

The fixing apparatus of the invention achieves the following advantages:

(1) A highly uniform coating of release agent in a minimum required amount is supplied resulting in economical use of the release agent.

(2) The porous fluorocarbon resin membrane used will not become clogged by toner or carrier particles and it is little worn by contact with the fixing roll. As a consequence, the apparatus can be used for a very extended period.

(3) The apparatus is very simple to set up, and oil will not leak out through any area of the porous fluorocarbon resin membrane other than that which corresponds to the slot in the overlying sheet.

It is to be understood that the apparatus of the present invention can be applied not only to a copying machine but also to facsimile devices and other machines that have a fixing mechanism.

What is claimed is:

1. An apparatus for fixing a toner image by transporting a toner image bearing material as it is held between a fixing roll and a compression roll comprising: means for supplying a release agent having a viscosity of 50 to 100,000 cS to a porous fluorocarbon resin membrane for applying said release agent onto the surface of said fixing roll, said porous fluorocarbon resin membrane, in the area of said membrane through which said release agent is to pass through, having a pore size of 0.01 to 10 μm, a porosity of 35 to 85%, and a thickness of 50 μm to 1 mm, said porous fluorocarbon resin membrane including closed pores in areas other than through which said release agent is to pass through, said apparatus being positioned above said fixing roll, and wherein said porous fluorocarbon resin membrane comprises a linear zonal projection adapted to contact a circumferential surface of said fixing roll in an axial direction, said projection having a concave portion filled with a shape retaining member, and wherein said shape retaining member is located on the surface of the projection opposite the surface contacting the fixing roll.

2. The apparatus according to claim 1 wherein said shape retaining member comprises a hollow porous member having a circular cross section.

3. The apparatus according to claim 1 wherein said shape retaining member comprises a solid porous member having a circular cross section.

4. The apparatus according to claim 2 wherein said hollow porous member having a circular cross section comprises a porous tetrafluoroethylene resin tube having pores larger than those of said porous fluorocarbon resin membrane and having a porosity of 50 to 85%.

5. The apparatus according to claim 3 wherein said solid porous member having a circular cross section comprises a porous tetrafluoroethylene resin cylinder having a porosity of 35 to 85%.

6. The apparatus according to claim 3 wherein said solid porous member having a circular cross section is made of heat-resistant felt.

7. An apparatus for fixing a toner image by transporting a toner image bearing material as it is held between a fixing roll and a compression roll comprising: means for supplying a release agent having a viscosity of 50 to 100,000 cS to a porous fluorocarbon resin membrane for applying said release agent onto the surface of said fixing roll, said porous fluorocarbon resin membrane, in the area of said membrane through which said release agent is to pass through, having a pore size of 0.01 to 10 μm, a porosity of 35 to 85%, and a thickness of 50 μm to 1 mm, said porous fluorocarbon resin membrane including closed pores in areas other than through which said release agent is to pass through, said apparatus being positioned above said fixing roll, and wherein said supplying means comprises a tank for storing said release agent and wherein an opening is made in at least part of a bottom of said tank, said porous fluorocarbon resin membrane being placed on an inner surface of said bottom of said tank.

8. The apparatus according to claim 7 wherein said opening is a slot made in a longitudinal direction of said fixing roll.

9. An apparatus for fixing a toner image by transporting a toner image bearing material as it is held between a fixing roll and a compression roll comprising: means for supplying a release agent having a viscosity of 50 to 100,000 cS to a porous fluorocarbon resin membrane for applying said release agent onto the surface of said fixing roll, said porous fluorocarbon resin membrane, in the area of said membrane through which said release agent is to pass through, having a pore size of 0.01 to 10 μm, a porosity of 35 to 85%, and a thickness of 50 μm to 1 mm, said porous fluorocarbon resin membrane including closed pores in areas other than through which said release agent is to pass through, said apparatus being positioned above said fixing roll, and wherein said supplying means comprises a tank for storing said release agent and wherein an opening is made in at least part of a bottom of said tank, said porous fluorocarbon resin membrane having a projection shaped so as to fit in said opening in such a manner that said projection extends beyond said bottom of said tank, said projection having a concave portion and a shape retaining member being fit in said concave portion.

10. The apparatus according to claim 9 wherein said opening is a slot formed in a longitudinal direction of said fixing roll and said projection extends in a longitudinal direction of said fixing roll.

11. The apparatus according to any of claims 7, 8, 9 or 10 wherein said tank is made of a thermoplastic resin, said porous fluorocarbon resin membrane being mounted between a holding plate made of a thermoplastic resin and said bottom of said tank, said porous fluorocarbon resin membrane being fixed to said tank by fusion-bonding said tank to said holding plate while heating.

12. The apparatus according to claim 11 wherein said thermoplastic resin is a polyphenylene sulfide resin containing not more than 35% of glass fibers.

13. The apparatus according to claim 11 wherein said thermoplastic resin is 6,6-nylon containing not more than 40% of glass fibers.

14. The apparatus according to claim 11 wherein said thermoplastic resin is a polyethylene terephthalate resin containing not more than 40% of glass fibers.

15. The apparatus according to claim 11 wherein said fusion-bonding while heating is carried out by ultrasonic welding.

16. The apparatus according to claim 11 wherein said fusion-bonding while heating is carried out by high-frequency welding.

17. An apparatus according to claim 11 wherein lugs are formed in at least part of a periphery of said porous fluorocarbon resin membrane and said fusion-bonding while heating is carried out in such a manner that said lugs are formed between adjacent portions where said tank is fusion-bonded to said holding plate.

* * * * *